US006409365B1

(12) United States Patent
Lin

(10) Patent No.: US 6,409,365 B1
(45) Date of Patent: Jun. 25, 2002

(54) HANGING-TYPE DETACHABLE LAMP SHADE AND LIGHT BULB SOCKET ASSEMBLY STRUCTURE

(76) Inventor: Shih-Ming Lin, No. 132, Hsi Hsin Street, Chang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 09/873,324

(22) Filed: Jun. 5, 2001

(51) Int. Cl.[7] ..... F21S 8/06
(52) U.S. Cl. ..... 362/404; 362/434
(58) Field of Search ..... 362/404, 407, 362/147, 278, 403, 437, 452, 353, 355, 391

(56) References Cited

U.S. PATENT DOCUMENTS 838,950 A * 12/1906 Coger ..... 250/495.1
3,693,001 A * 9/1972 Rogers ..... 362/434

* cited by examiner

*Primary Examiner*—Sandra O'Shea
*Assistant Examiner*—Hargobind S. Sawhney
(74) *Attorney, Agent, or Firm*—Troxell Law Office PLLC

(57) ABSTRACT

A hanging-type lamp shade having an insulator sleeve at the bottom section and a light bulb unit in the interior section. The lamp shade has a center ring at the mid-point of its diameter and, furthermore, an opening is formed from a through-hole in the center ring towards its circumferential edge that accommodates the insertion of a power cord. A collar projects downward vertically from the centered annular edge of the through-hole of the center ring such that the collar is around the periphery of a threaded rod, and the insulator sleeve and the light bulb unit are situated at the bottom end of the lamp shade. Furthermore, a washer is installed between the insulator sleeve and light bulb unit that leaves an intervening space of separation, thereby providing for the directed flow of light bulb heat to reduce the interior temperature of the lamp shade.

5 Claims, 7 Drawing Sheets

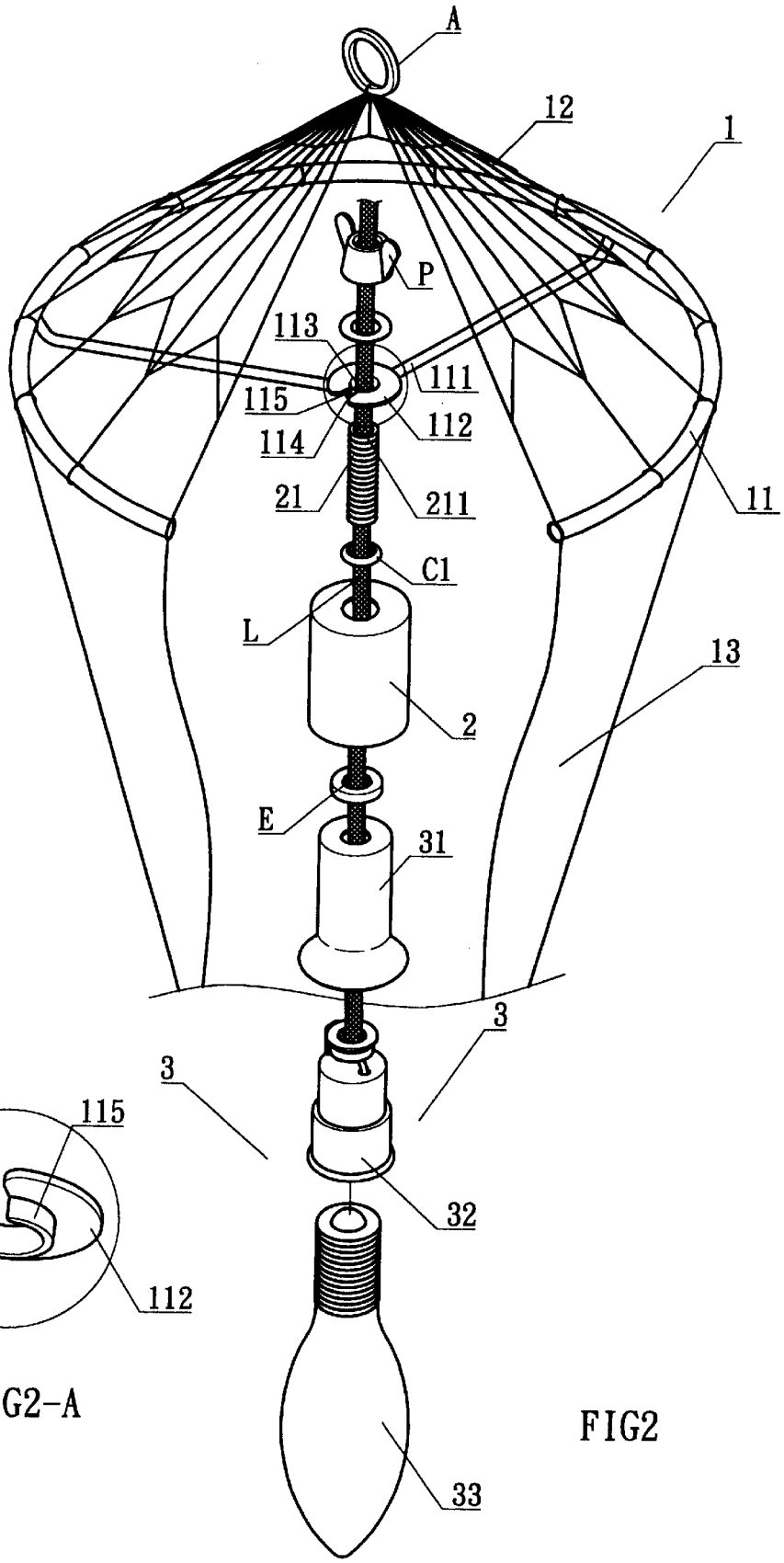
FIG2
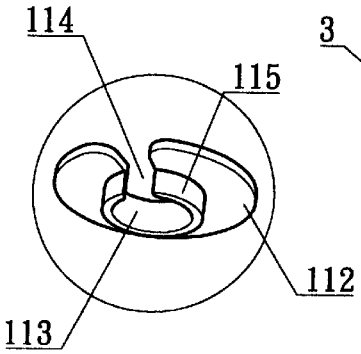
FIG2-A

FIG4-A

HANGING-TYPE DETACHABLE LAMP SHADE AND LIGHT BULB SOCKET ASSEMBLY STRUCTURE

BACKGROUND OF THE INVENTION

1) Field of the Invention

The invention herein relates to a hanging-type detachable lamp shade and light bulb assembly structure having an insulator sleeve at the bottom section and a light bulb unit in the interior section, wherein the lamp shade has a center ring at the mid-point of its diameter and, furthermore, an opening is formed in the center ring from a through-hole and towards its circumferential edge that accommodates the insertion of a power cord and a collar projects downward vertically from the centered annular edge of the through-hole of the center ring; furthermore, a heat dissipation space is left in between an insulator sleeve and a light bulb unit that serves as a buffer that reduces the interior temperature of the lamp shade; as such, when the lamp shade body is swayed leftward and rightward by an external force, high-temperature contact between the lamp shade and the light bulb that results in surface blackening or burning is prevented and, furthermore, the lamp shade is removable for replacement and cleaning.

2) Description of the Prior Art

A conventional hanging-type lamp shade assembly structure, referring to FIG. 1, is comprised of a hanging-type lamp shade 1 suspended from the bottom of a power cord L and a light bulb 5 connected to a power source; the top wire 11 of the lamp shade 1 has bracing rods 111 extending from its circumferential edge to the center and a center ring 113 disposed at its mid-diameter point, which thereby constitutes the said hanging-type lamp shade; however, since the said hanging-type lamp shade has structural flaws that have given rise to numerous practical shortcomings, manufacturers still await further improvement and refinement, with the drawbacks including the following examples that are provided for reference.

Since there is no locking or mounting structure on the threaded rod 51 section between the said lamp shade 1 and the light bulb unit 5, when the lamp shade is subjected to an external force (such as wind or other force) and is swayed leftward and rightward, only the lamp shade 1 swings and the light bulb unit 5 does not move along with the lamp shade 1, easily resulting in the light bulb unit 5 hitting its sides, with the high-temperature contact of the light bulb blackening or burning the lamp shade 1.

Furthermore, the assembly of the conventional lampshade involves first inserting the power cord L through the lamp shade 1 and then connecting the bottom end of the power cord L to the light bulb unit 5 such that after the lamp shade 1 and the light bulb unit 5 are assembled, the light bulb unit 3 cannot be removed from the interior section of the lamp shade 1; therefore, once the lamp shade is assembled, it cannot be replaced as necessary to satisfy user requirements of pattern and color and, furthermore, removal of the lamp shade 1 for cleaning is also not possible, all of which results in impractical utilization.

SUMMARY OF THE INVENTION

The primary objective of the invention herein is to provide a hanging-type detachable lamp shade and light bulb assembly structure in which the lamp shade has a center ring at the mid-point of its diameter and, furthermore, an opening is formed from a through-hole in the center ring towards its circumferential edge that accommodates the insertion of a power cord; a collar projects downward vertically from the centered annular edge of the through-hole of the center ring such that the collar is around the periphery of a threaded rod, and an insulator sleeve and a light bulb unit are situated at the bottom end of the lamp shade and, furthermore, a washer is placed in between a heat sink jacket and the insulator sleeve, leaving an intervening space separating the two components that provides for the upward dissipation of heat from the light bulb and partial flow into the space, which serves as a buffer that reduces the interior temperature of the lamp shade; as such, the lamp shade is capable of moderating the high temperature of the light bulb and, furthermore, when the lamp shade body is subjected to an external force and is swayed leftward and rightward, high-temperature contact between the lamp shade and the light bulb that results in surface blackening or burning is prevented; moreover, the lamp shade can be removed for replacement or cleaning as necessary.

Another objective of the invention herein is to provide a hanging-type detachable lamp shade and light bulb assembly structure in which the power cord is directly inserted into the opening of the center ring and positioned in the through-hole of the center ring, with the heat sink jacket and light bulb unit mounted at the lower extent of the center ring, such that when the lamp shade is disassembled, it is only necessary to extract the power cord from the opening of the center ring to remove the lamp shade; as such, the lamp shade can be installed or removed as required by the user to change lamp shade pattern and color; furthermore, the lamp shade is easily removed for cleaning when dirty, the present invention thereby achieving practicality as well as convenience.

BRIEF DESCRIPTION OF THE DRAWINGS

FIG. 2 is an exploded drawing of the invention herein.

FIG. 2-A is an isometric drawing in magnified view of the center ring of the invention herein.

FIG. 4-A is a partial cross-sectional drawing of the wall lamp embodiment of the invention herein.

FIG. 6-A is a partial magnified drawing of the assembly details.

FIG. 7-A is a partial magnified drawing of the assembly details.

DETAILED DESCRIPTION OF THE INVENTION

Figure 1:
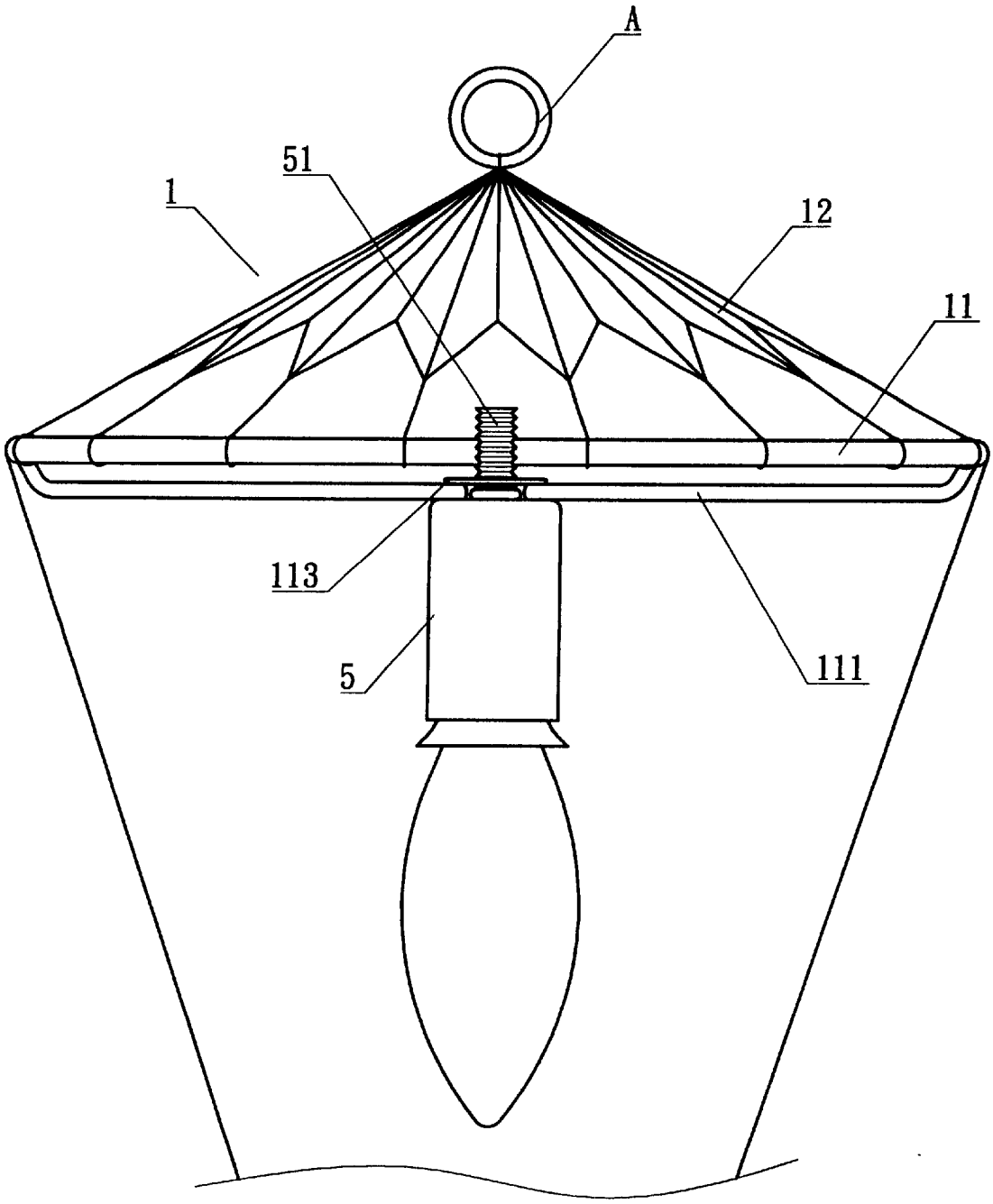
FIG1 PRIOR ART
FIG. 1 is a cross-sectional drawing of a conventional lamp shade.
Figure 3:
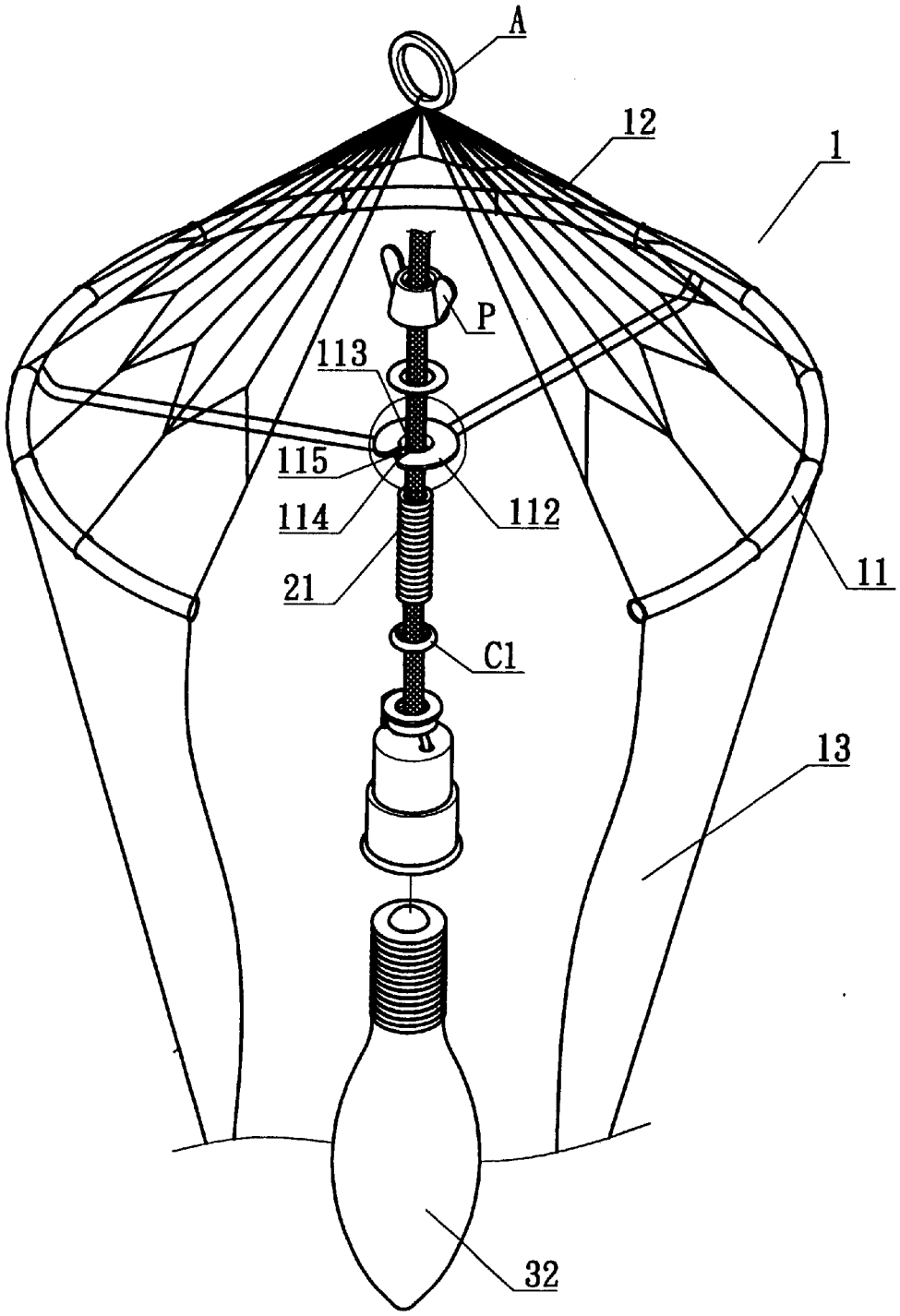
FIG. 3 is an exploded drawing of another embodiment of the invention herein.

Referring to FIG. 2 and FIG. 3, the structural arrangement of the present invention, the invention herein is comprised of a hanging-type lamp shade 1, an insulator sleeve 2 situated at the bottom section of the lamp shade 1, and a light bulb unit 3 positioned inside the insulator sleeve 2, of which:

The said lamp shade 1 consists of a top wire 11, material draped along the bottom end of the top wire 11 and, furthermore, a suspending ring A and carrier webbing 12 at the top end connected to the lamp shade body 13 such that suspending ring A is capable of supporting the weight of the lamp shade 1 when mounted on a fixture; the said top wire 11 is an annular structure that is circular in shape and constructed of metal and, furthermore, has bracing rods 111 extending from the center and a center ring 112 at the mid-diameter point; there is a through-hole 113 in the middle of the center ring 112 and, furthermore, an opening 114 formed from the through-hole 113 towards the circumferential edge, thereby providing for the insertion of the light bulb unit 3 power cord L into the opening 114 as well as the attachment of the light bulb unit 3 to the lamp shade 1; a collar 115 projects downward vertically from the centered annular periphery of the through-hole 113 and, furthermore, a threaded rod 21 of the insulator sleeve 2 extends pass the top end of the collar 115 and a wing nut P is fastened onto the threaded rod 21 to mount the insulator sleeve 2 to the bottom end of the center ring 113.

The said insulator sleeve 2 is situated over the exterior section of the light bulb unit 3 and, furthermore, the threaded rod 21, which has a passage 211 disposed through it, is inserted through the center of the insulator sleeve 2, the passage 211 providing for the internal routing of the power cord L; the bottom end of the threaded rod 21 extends into the interior section of a heat sink jacket 31 between the insulator sleeve 2 and the light bulb unit 3 and then fastened to the bottom end of the heat sink jacket 31 by a nut C and, furthermore, the nut C fastens it to a lamp bulb cap 32; the threaded rod 21 is then placed into the through-hole 113 of the center ring 112 and the wing nut P is fastened onto the threaded rod 21 to mount the insulator sleeve 2 to the light bulb unit 3 at the bottom end of the lamp shade 1 center ring 112.

The said light bulb unit 3 is situated in the heat sink jacket 31 within the interior section of the insulator sleeve 2 and consists of the light bulb cap 32 fastened inside the heat sink jacket 31 and a light bulb 33; a washer E is placed in between the said heat sink jacket 31 and insulator sleeve 2, leaving an intervening space S separating the two components that provides for the upward dissipation of heat from the light bulb 33 and partial flow into the space S, which serves as a buffer that reduces the interior temperature of the lamp shade 1; after the power cord L at the top end of the light bulb cover 32 is respectively inserted through the heat sink jacket 31, the insulator sleeve 2, and the center ring 112 of the lamp shade 1, it is connected to a power source.

Following the assembly of the said light bulb unit 3 to the insulator sleeve 2, both components are inserted into the center ring 112 of the lamp shade 1 such that the collar 115 projecting downward vertically from the center ring 112 is against the threaded rod 21; then, the wing nut P is fastened onto the threaded rod 21 to secure the insulator sleeve 2 to the light bulb unit 3 at the lower extent of the lamp shade 1 center ring 112; as such, since the heat dissipation space S left between the insulator sleeve 2 and the light bulb unit 3 provides for the upward transfer of heat from the light bulb 33 and partial flow into the space S, the buffering that results reduces the interior temperature of the lamp shade 1; furthermore, when the lamp shade body 13 is subjected to an external force (such as wind or other force) and is swayed leftward and rightward, since the area of contact between the center ring 112 collar 115 and the insulator sleeve 2 is relatively large, this ensures that the insulator sleeve 2 and the light bulb unit 3 swing along with the lamp shade 1, thereby preventing high-temperature light bulb 33 contact that blackens or bums the surface of the lamp shade 1 while the lamp shade 1 is swaying.

Referring to FIG. 3, the drawing of another embodiment of the invention herein, the said embodiment is comprised of a top wire 11, carrier webbing 12, a lamp shade body 13, and a light bulb 32 suspended from a power cord L at the bottom end of the lamp shade body 13 and, furthermore, a center ring 112 is formed at the mid-diameter point of the said top wire 11; the innovative feature of the said embodiment is that a threaded rod 21 having a passage disposed through it is inserted at the center of the said top wire 11 and, furthermore, an opening 114 is formed from the through-hole 113 towards the circumferential edge of the center ring 112 of the top wire 11, thereby providing for the insertion of the power cord L into the opening 114 and, furthermore, a collar 115 projects downward vertically from the centered annular periphery of the through-hole 113 of the center ring 112 and the collar 115 is situated around the periphery of the threaded rod 21, allowing the light bulb 32 to swing along with the lamp shade 1 and thereby preventing high-temperature contact between the lamp shade 1 and the light bulb 32 that results in surface blackening or burning.

Moreover, since the assembly of the light bulb unit to the lamp shade 1 involves the insertion of the power cord L into the opening 112 of the center ring 114 and its positioning in the through-hole 113 of the center ring 112 as well as mounting the said heat sink jacket and light bulb unit at the lower extent of the center ring 112, when the lamp shade 1 is disassembled, it is only necessary to extract the power cord L from the opening 114 of the center ring 112 to remove the lamp shade 1; as such, the lamp shade 1 can be installed or removed as required by the user to change pattern and color; furthermore, since the lamp shade is also easily removed for cleaning when dirty, the present invention thereby achieves practicality as well as convenience.

When the present invention is utilized for heavier or larger load applications, after the threaded rod 21 is respectively inserted into the said insulator sleeve, the light bulb unit, and the through-hole 113 of the center ring 112, the wing nut P is fastened onto the threaded rod 21 to secure the insulator sleeve at the upper extent of the center ring 112 and mount the insulator sleeve 2 and the light bulb unit 3 at the bottom end of the lamp shade 1 center ring 112; when the lamp shade load is greater, a nut C and C1 is fastened onto the top and bottom ends of the threaded rod 21 to pre-position the said insulator sleeve 2 and the light bulb unit 3, the light bulb unit power cord L is next respectively inserted through the heat sink jacket 32 and the insulator sleeve 2 and then directly hung at the power source area to support the weight of the light bulb unit.

Figure 4:
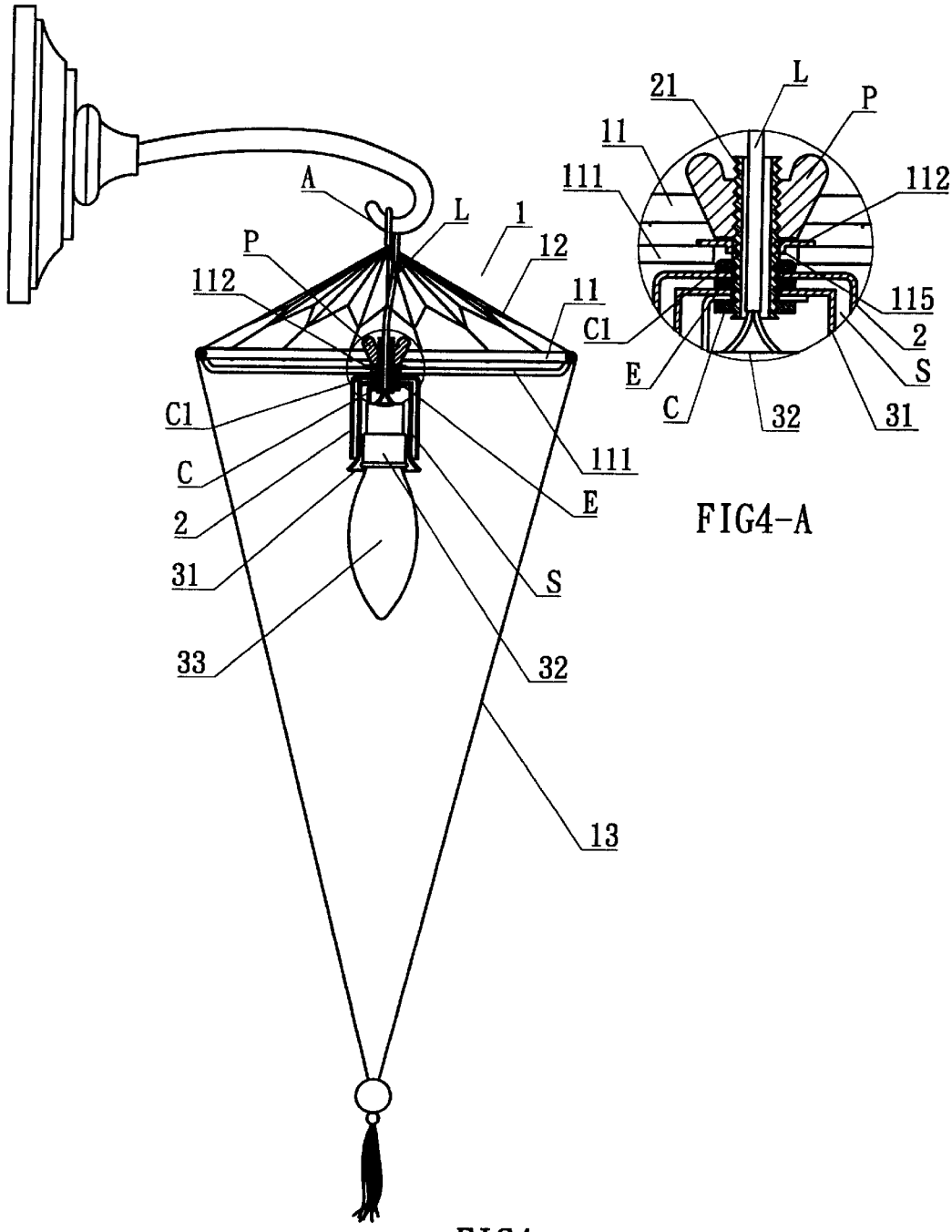
FIG. 4 is a cross-sectional drawing of the lamp shade of the invention herein in the wall lamp embodiment.
Figure 5:
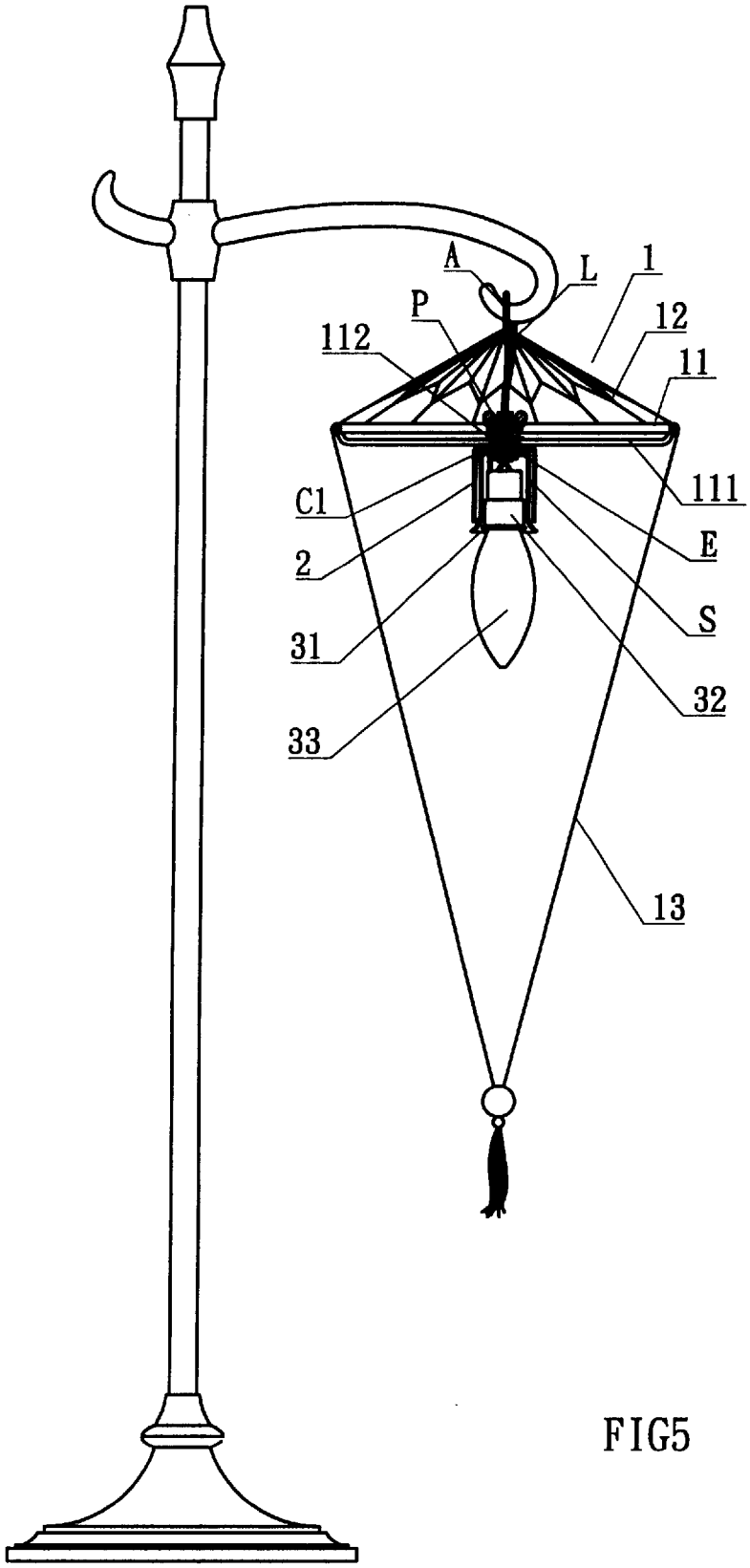
FIG. 5 is a cross-sectional drawing of the floor lighting device lamp shade embodiment.
Figure 6:
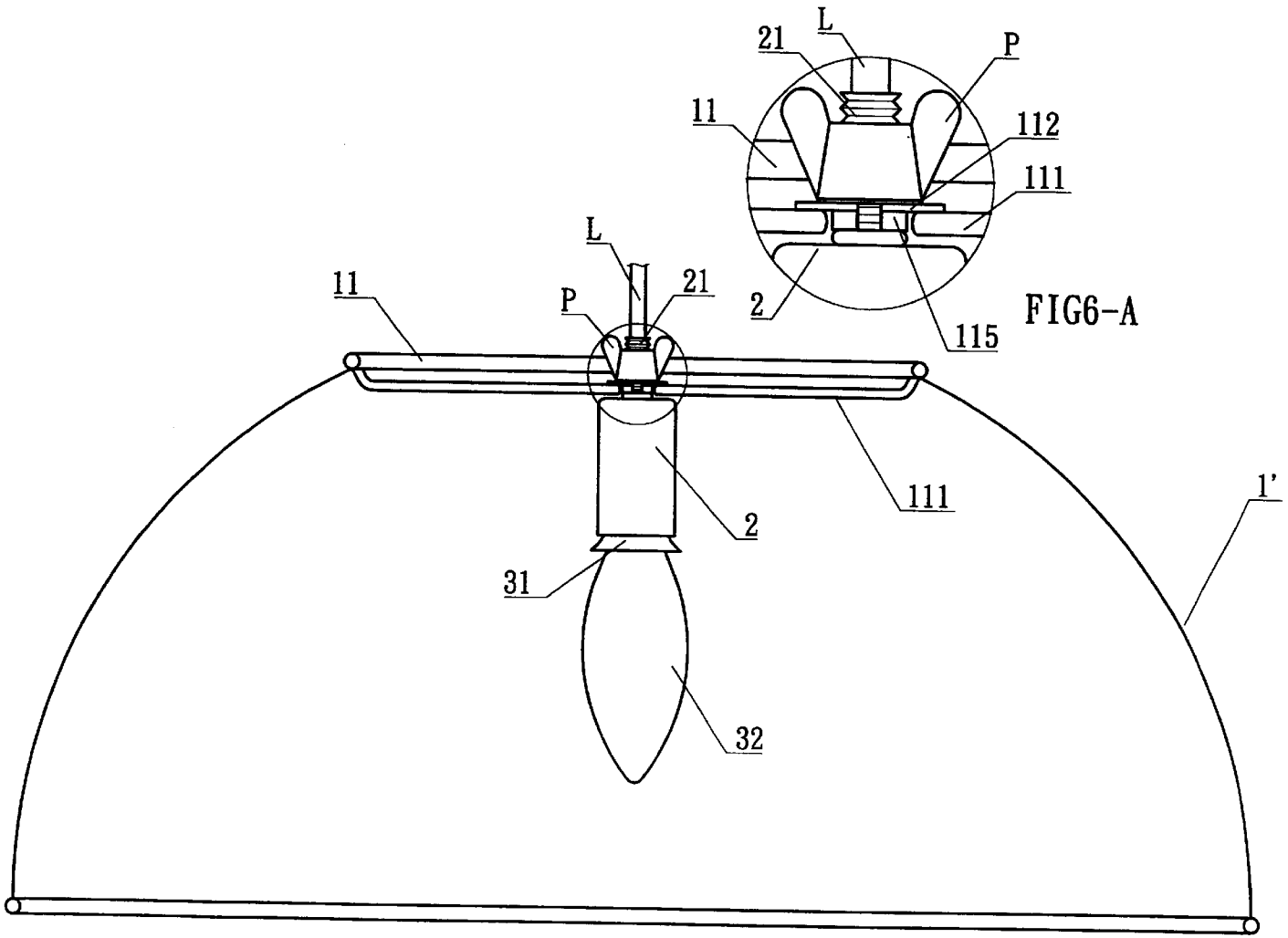
FIG. 6 is a cross-sectional drawing of the hemispherical lamp shade.
Figure 7:
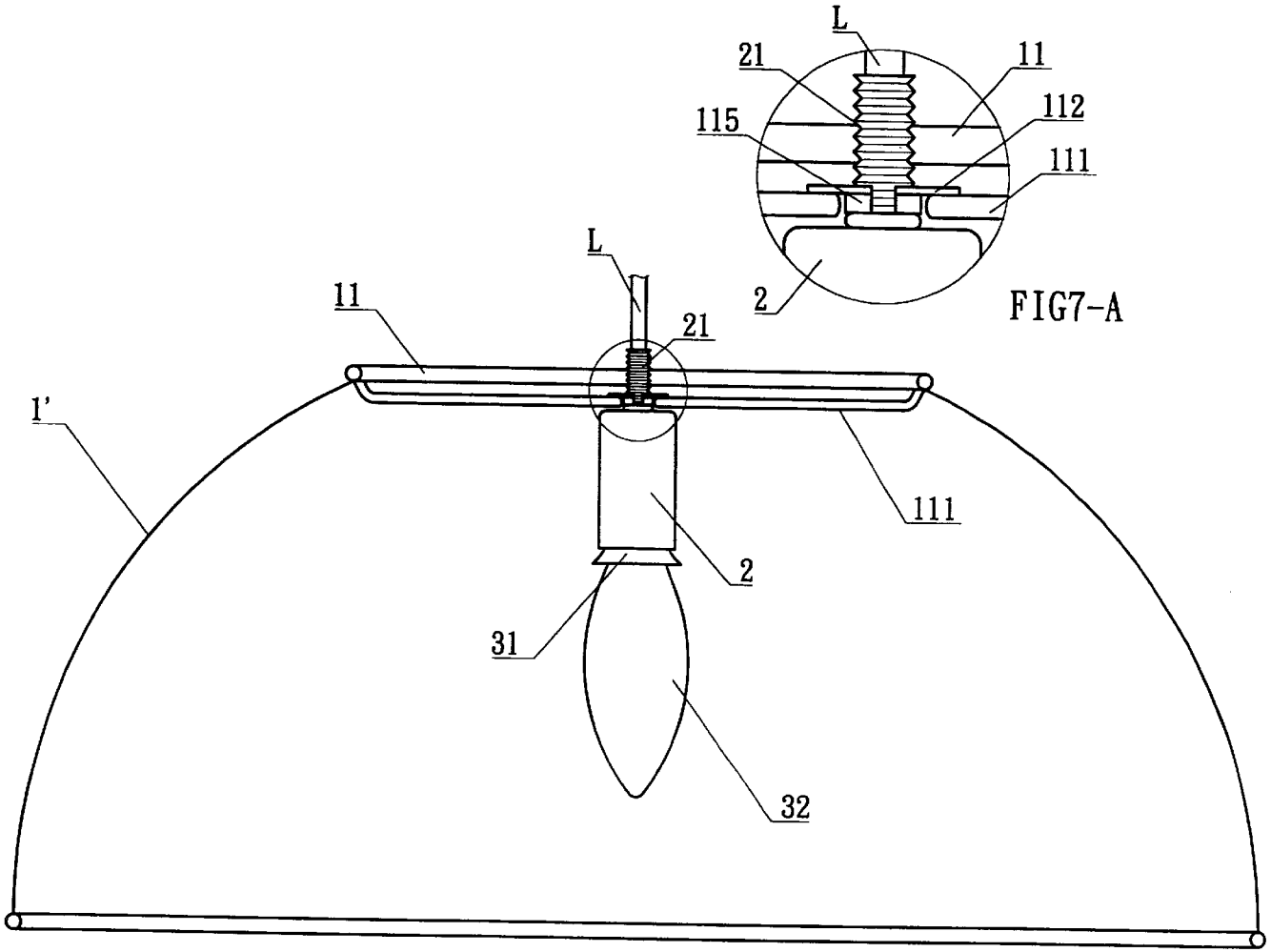
FIG. 7 is a cross-sectional drawing of the hemispherical lamp shade embodiment.

Referring to FIG. 4, FIG. 4-A, FIG. 5, FIG. 6, FIG. 6-A, FIG. 7, and FIG. 7-A, the respective drawings of the wall lamp, floor lamp, and hemispherical lamp shade 1' embodiments of the present invention, wherein the hemispherical lamp shade 1' shown in FIG. 7 is an embodiment in which the fastening wing nut P is not required (the heavier load lamp shade embodiment is utilized).

What is claimed is:

1. A hanging-type detachable lamp shade and light bulb socket assembly structure, said lamp shade comprised of a top wire, carrier webbing, a lamp shade body, and a light bulb suspended from a power cord at the bottom end of said lamp shade body and, furthermore, a center ring is formed at the mid-diameter point of said top wire; the innovative feature is that a threaded rod having a passage disposed through it is inserted at the center of said top wire and, furthermore, an opening is formed from a through-hole towards the circumferential edge of said top wire center ring, thereby providing for the insertion of a power cord into said opening and, furthermore, a collar projects downward vertically from the centered annular edge of the said through-hole of said center ring and said collar is situated around the periphery of the threaded rod, allowing said light bulb to swing along with said lamp shade and furthermore, enabling the removal of said lamp shade for replacement and cleaning.

2. An hanging-type detachable lamp shade and light bulb socket assembly structure according to claim 1, wherein said lamp shade is installed or removed as required by the user to change pattern and color.

3. An hanging-type detachable lamp shade and light bulb socket assembly structure according to claim 1, wherein said insulator sleeve and the said light bulb unit are respectively inserted into said through-hole of the said center ring, following which they are fastened to the upper extent of said center ring by a wing nut and, furthermore, said wing nut is fastened onto the said threaded rod to secure the said insulator sleeve such that said insulator sleeve and the said light bulb unit are mounted at the bottom end of said lamp shade center ring.

4. A hanging-type detachable lamp shade and light bulb socket assembly structure according to claim 1, wherein a nut is fastened onto the top and bottom ends of said insulator sleeve threaded rod to pre-position said insulator sleeve and the said light bulb unit; said light bulb unit power cord is next respectively inserted through the said heat sink jacket and said insulator sleeve and then suspended at a power source area to support the weight of said light bulb unit.

5. A hanging-type detachable lamp shade and light bulb socket assembly structure comprised of a hanging-type lamp shade, an insulator sleeve situated at the bottom section of the lamp shade, and a light bulb unit positioned inside the insulator sleeve; a center ring is formed away from the circumferential edge and towards the mid-diameter point of a top wire of said lamp shade and, furthermore, a power cord is situated at the top end of the said light bulb unit which is suspended from the power cord and said insulator sleeve is mounted on the center ring of said lamp shade; the innovations of which include:

the said top wire center ring has a through-hole in the middle and an opening formed towards its circumferential edge to provide for the insertion of said power cord and, furthermore, a collar projects downward vertically from the annular edge of said through-hole of the said center ring and the said collar is situated around the periphery of a threaded rod of said light bulb unit;

the said insulator sleeve has inserted at its center said threaded rod, which has a passage disposed through it; the bottom end of said threaded rod respectively extends into the interior section of a heat sink jacket between said insulator sleeve and said light bulb unit and is fastened to the bottom end of said heat sink jacket by a nut, said nut fastening said components into a single structural entity with a light bulb cap;

the said light bulb unit is situated in the said heat sink jacket within the interior section of said insulator sleeve and consists of the said light bulb cap fastened inside said heat sink jacket and a light bulb situated at the bottom end of said light bulb cap; a washer is placed in between the said heat sink jacket and said insulator sleeve, leaving an intervening space separating said two components:

as such, light bulb temperature is reduced and high-temperature contact between the said lamp shade and said light bulb that causes surface blackening or burning is prevented.

* * * * *